US006558153B2

(12) United States Patent
Schutz et al.

(10) Patent No.: US 6,558,153 B2
(45) Date of Patent: May 6, 2003

(54) LOW POLLUTION EMISSION BURNER

(75) Inventors: Wayne D. Schutz, Monroe, WI (US); Eugene A. Showers, Monroe, WI (US)

(73) Assignee: Aqua-Chem, Inc., Milwaukee, WI (US)

( * ) Notice: Subject to any disclaimer, the term of this patent is extended or adjusted under 35 U.S.C. 154(b) by 71 days.

(21) Appl. No.: 09/823,661

(22) Filed: Mar. 30, 2001

(65) Prior Publication Data

US 2001/0046649 A1 Nov. 29, 2001

Related U.S. Application Data

(60) Provisional application No. 60/193,885, filed on Mar. 31, 2000.

(51) Int. Cl.[7] ..... F23D 14/22; F23D 14/68

(52) U.S. Cl. ..... 431/4; 431/115; 431/163; 431/181; 431/190; 431/284; 122/235.13

(58) Field of Search ..... 431/115, 4, 163, 431/190, 12, 181, 284, 285; 122/235.13; 239/422, 423

(56) References Cited

U.S. PATENT DOCUMENTS

| | | | | |
|---|---|---|---|---|
| 2,822,864 A | * | 2/1958 | Black | 431/284 |
| 3,955,909 A | | 5/1976 | Craig et al. | |
| 4,013,499 A | | 3/1977 | Benigni | |
| 4,023,921 A | | 5/1977 | Anson | |
| 4,050,877 A | | 9/1977 | Craig et al. | |
| 4,089,629 A | | 5/1978 | Baumgartner et al. | |
| 4,105,163 A | | 8/1978 | Davis, Jr. et al. | |
| 4,138,725 A | | 2/1979 | Ikemoto et al. | |
| 4,230,445 A | * | 10/1980 | Janssen | 431/116 |
| 4,297,093 A | | 10/1981 | Morimoto et al. | |
| 4,659,305 A | | 4/1987 | Nelson et al. | |
| 4,995,807 A | | 2/1991 | Rampley et al. | |
| 5,092,761 A | * | 3/1992 | Dinicolantonio | 431/115 |
| 5,129,818 A | | 7/1992 | Balsiger | |
| 5,195,883 A | | 3/1993 | Hanna et al. | |
| 5,257,927 A | | 11/1993 | Lang | |
| 5,411,394 A | | 5/1995 | Beer et al. | |
| 5,451,160 A | | 9/1995 | Becker | |
| 5,460,512 A | * | 10/1995 | Lifshits et al. | 431/115 |
| 5,471,957 A | * | 12/1995 | Brady et al. | 110/234 |
| 5,511,970 A | | 4/1996 | Irwin et al. | |
| 5,522,696 A | | 6/1996 | Stansfield | |
| 5,601,424 A | | 2/1997 | Bernstein et al. | |
| 5,603,906 A | | 2/1997 | Lang et al. | |
| 5,634,785 A | | 6/1997 | Bury et al. | |
| 5,667,374 A | | 9/1997 | Nutcher et al. | |
| 5,667,376 A | | 9/1997 | Robertson et al. | |
| 5,798,946 A | | 8/1998 | Khesin | |
| 5,832,846 A | | 11/1998 | Mankowski et al. | |
| 5,924,275 A | | 7/1999 | Cohen et al. | |
| 5,983,642 A | | 11/1999 | Parker et al. | |
| 5,984,665 A | | 11/1999 | Loftus et al. | |
| 6,006,167 A | | 12/1999 | Bunting | |
| 6,027,330 A | | 2/2000 | Lifshits | |
| 6,049,738 A | | 4/2000 | Kayama et al. | |

FOREIGN PATENT DOCUMENTS

| | | |
|---|---|---|
| WO | 99/37952 | 7/1999 |

* cited by examiner

*Primary Examiner*—Sara Clarke
(74) *Attorney, Agent, or Firm*—Whyte Hirschboeck Dudek SC

(57) ABSTRACT

A combustion method and burner system are disclosed herein. The burner system comprises: a fuel manifold comprising a housing, the housing defining an interior area comprising a chamber. The burner system comprises a set of injectors for injecting a fuel from the chamber into a stream of air to pre-mix the fuel and the air, the set of injectors disposed radially inward from the fuel manifold. The system includes a refractory located downstream of the fuel manifold, the refractory to shape a flame and the refractory comprising a plurality of channels for at least one of introducing air and combustion product into a combustion chamber, the combustion chamber located downstream of the refractory. The system can also include steam and/or water injection.

32 Claims, 13 Drawing Sheets

LOW POLLUTION EMISSION BURNER

CROSS-REFERENCE TO RELATED APPLICATION

This application claims the benefit of U.S. Provisional Application No. 60/193,885 filed Mar. 31, 2000.

BACKGROUND OF THE INVENTION

The present invention relates generally to a burner system, and more particularly, to a burner and burner combustion process having very low pollutant emission throughout the burner firing range.

Fuel burners are used in boilers, heaters, and other applications for the conversion of fuel to heat. The heat is then transferred to make hot water, steam, and/or warm air, or to create power, depending upon the application. Burners generally mix fuel and air and then direct the mixture for the purpose of creating rapid ignition and complete combustion.

Primary air is usually initially mixed with fuel resulting in rapid ignition of a flame. The primary air also serves to convey the fuel through the burner. Most burners are then designed to introduce additional secondary air as necessary at a later point to provide for complete combustion.

Oxides of nitrogen and carbon monoxide are gaseous pollutant products of the combustion of hydrocarbon fuels. Pollution level restrictions promulgated by the Environmental Protection Agency call for the reduction or elimination of these pollutants.

In particular, nitrogen oxide ($NO_x$) emission regulations that are applied to combustion processes are becoming increasingly stringent. For example, California's South Coast Air Quality Management District ("SCAQMD") has promulgated regulations to limit the $NO_x$ emissions from burners operating with natural gas to a level of less than 25 parts per million on a volume basis ("ppmv", or simply referred to herein as "ppm"), when corrected to a 3% oxygen level. Other states too are exploring, or have already passed, similar legislation.

In general, reducing pollutant emissions generated by way of fuel-burning processes can be accomplished in one of two ways: first, by selecting a fuel having the lowest overall level of pollutants, and second, by developing burning apparatuses and processes which can minimize the production and release of pollutants.

Combustion reactions can generally produce $NO_x$ via one of two mechanisms, depending on the type of fuel that is used. First, fuel $NO_x$ is produced from chemically bound nitrogen present in the fuel that is to be combusted. Second, thermal $NO_x$ is produced in high temperature flames by fixation from nitrogen and oxygen present in the combustion air. As a practical matter, depending on the nitrogen concentration present in the fuel, fuel $NO_x$ generation rates can be orders of magnitude greater than thermal $NO_x$ generation rates.

$NO_x$ emission may be limited to the thermal variety if natural gas (rather than coal or oil for instance) is employed as the fuel of choice, since clean natural gas does not comprise any nitrogen containing compounds. The generally accepted mechanism for thermal $NO_x$ formation can be described by the following reaction equations:

$$N_2+O \Leftrightarrow NO+N \quad (1)$$

$$O_2+N \Leftrightarrow NO+O \quad (2)$$

Additionally, it is generally known that the $NO_x$ generation rate can be decreased by cooling the temperature of a combustion flame in a burner. Further, a decrease in combustion flame temperature most significantly effects the production of thermal $NO_x$. Also, $NO_x$ pollution reduction by way of a reduction in the combustion flame temperature is most effective when natural gas is the fuel of choice.

Current low $NO_x$ burners include post combustion or flue gas scrubbing mechanisms that typically involve a catalytic process that typically requires expensive add-ons. Also, metal fiber burners or ceramic heads can be constructed to lower emissions, but such devices tend to require high excess air levels (normally around 9 percent $O_2$). This results in an increase in overall fuel consumption. Further, these and other current low pollutant burners/burner add-ons are often unreliable and can require significant servicing. Moreover, such burners/burner add-ons often yield poor flame density and shape, this can result in an unstable combustion process.

Incomplete combustion results in the gaseous combustion products containing a high percentage of CO, unburned hydrocarbons and carbonaceious materials. Complete combustion results in the oxidizing of such CO, hydrocarbons and carbonaceous materials into innocuous $CO_2$. Ideally, complete combustion can take place under conditions (e.g., lower temperature) that will not result in nitrogen (again, present in fuel and air) being oxidized to form significant quantities of $NO_x$.

Burner and boiler systems with burners are well known and commercially available. Generally, methods for reducing combustion emissions, combustion product discharge, and pollutants, are also known. These topics are discussed with varying degrees of particularity in U.S. Pat. Nos. 5,667,374, 5,195,883, 5,522,696, 4,659,305, 4,050,877, 4,013,499, and 3,955,909, the disclosures of which are incorporated by reference herein.

It would be desirable to have a low $NO_x$ emission burner that solves the aforementioned problems. More specifically, it would be desirable to have a low $NO_x$ emission burner that lowers the excess air requirements of current burners, reduces the $NO_x$ emissions to a level of less than 12 parts per million (ppm). Additionally, the burner would preferably reduce CO emission to a level of less than 50 ppm. Further, the preferred burner would achieve these emission levels reliably, consume less fuel while attaining better combustion efficiencies, all without requiring expensive add-on equipment or additional manufacturing and maintenance costs typically associated with other such low pollutant burners.

SUMMARY OF THE INVENTION

The present invention provides a low pollutant emission burner that overcomes the aforementioned problems, and does so in a fashion that is cost effective, efficient and adaptable to a variety of uses and configurations.

Hence, in accordance with one aspect of the invention, a low pollution emission burner system is provided, the burner system comprising: a fuel manifold comprising a housing, the housing defining an interior area comprising a first chamber and a second chamber; a first set of injectors for injecting a fuel from the first chamber, the injectors disposed radially inward from the fuel manifold; a second set of injectors for injecting the fuel from the second chamber into a stream of air to pre-mix the fuel and the air, the second set of injectors disposed radially inward from the fuel manifold; a third set of injectors for injecting the fuel, the third set of injectors located in an area defined by at least one of the first and the second set of injectors; and a refractory located downstream of the fuel manifold, the refractory comprising a plurality of channels for introducing air and combustion product into a combustion chamber, the combustion chamber located downstream of the refractory. The burner system can comprise a steam injector located upstream of the first set of injectors, the steam injector for injecting steam within the burner.

In accordance with another aspect of the invention, a method for reducing pollution emissions from a burner, the method comprising the steps of: providing a fuel manifold comprising a housing, the housing defining an interior area comprising a first chamber and a second chamber; providing a first set of injectors, a second set of injectors, and a third set of injectors within a burner system, the first set of injectors connected to, and disposed radially inward from, the first chamber, the second set of injectors connected to the second chamber and the third set of injectors located in an area defined by at least one of the first and the second set of injectors; introducing air and fuel into the burner; injecting the fuel from the first set of fuel injectors; injecting the fuel from the second set of fuel injectors into a stream of air to obtain pre-mixture of fuel and air; injecting the fuel from the third set of fuel injectors; igniting at least one of the fuel and the mixture of fuel and air from at least one set of fuel injectors to create a flame and a resulting combustion product; recirculating at least a portion of combustion product into the burner; and passing at least one of air and at least a portion of the combustion product through at least one channel in the refractory to a location downstream of the refractory.

Accordingly, the invention accomplishes a reduction in air pollution by reducing $NO_x$ emissions to a level of less than about 10 ppm, CO emissions to a level of less than about 50 ppm, in addition to reducing the hydrocarbon and particulate content of the exhaust gases from carbonaceous and hydrocarbon fuel burners. Preferably, these reductions are achieved without sacrificing efficiency by using $O_2$ levels of between about 2.5 percent and about 3.5 percent. $O_2$ levels can be reduced to about 2 percent depending on the application at hand.

The inventive burner shortens, cools and more evenly shapes the burner flame and provides good flame stability throughout the burner combustion range so as to minimize burner servicing costs and increase, for example, boiler (or other apparatus to which the burner is attached) life expectancy. Hence, the inventive burner system provides a cost-effective approach to reducing pollutant emissions.

The inventive burner effectuates a reduction in $NO_x$ production without adversely affecting the thermal combustion efficiency of the burner by using heat that is normally lost to the stack to, for example, preheat combustion air.

The burner can reduce air pollutants, for example $NO_x$ and CO. The burner preferably is readily adaptable to various types of apparatuses, for example, boilers (e.g., water and fire tube boilers). The burner can preferably be incorporated into new boilers or added to existing units. The burner can allow boiler installations to meet increasingly stringent air quality emission limitations.

Various other aspects, features, objects and advantages of the present invention shall be made apparent from the following detailed description and the drawings.

BRIEF DESCRIPTION OF THE DRAWINGS

The various features, objects and advantages of this invention are best understood with reference to the preferred embodiments when read in conjunction with the following drawings. In addition, the drawings illustrate the best mode presently contemplated for carrying out the invention.

In the drawings:

FIG. 5C is a partial perspective view of one embodiment of a refractory/dry oven that can be incorporated for use in the burner system.

DETAILED DESCRIPTION OF THE PREFERRED EMBODIMENT

In the Figures, like numerals are employed to designate like parts through the drawings, and various pieces of equipment, such as valves, fittings, pumps, and the like, are omitted so as to simplify the description of the invention. However, those skilled in the art will realize that such conventional equipment can be employed as desired. In addition, although the invention is applicable to various fuel-burning apparatuses, it will be discussed for purposes of illustration in connection with a steam or hot water boiler.

Figure 1:
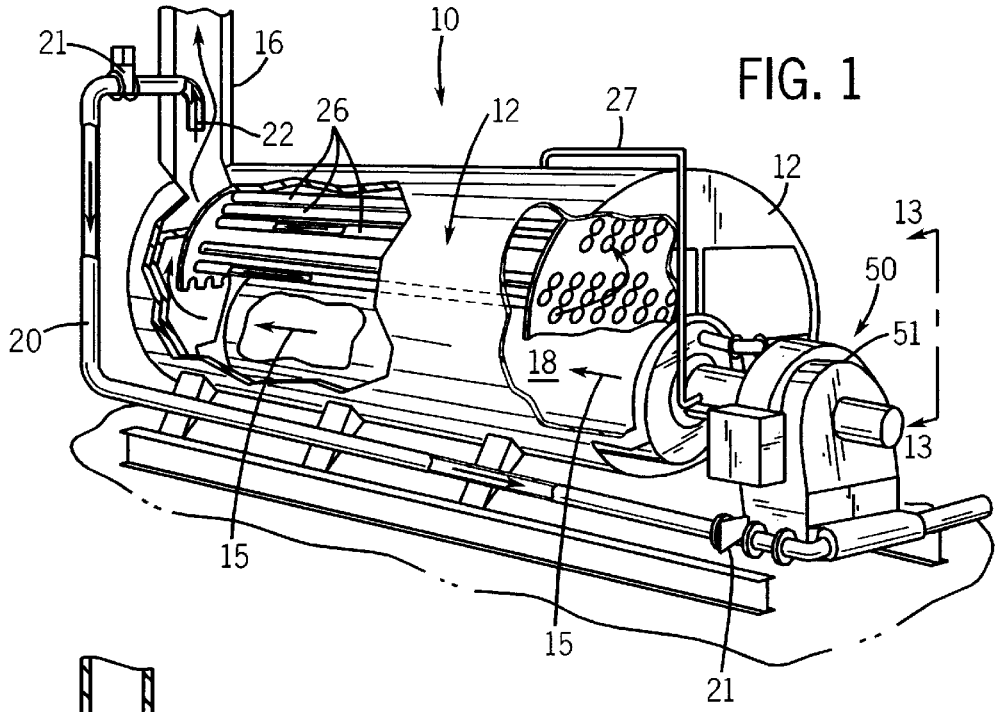
FIG. 1 is a partially schematic perspective view, partially cut-away, of a boiler comprising a burner system in accordance with the present invention.

FIG. 1 illustrates a boiler 10 for use with a burner system in accordance with the present invention. It is noted that the particular type or shape of boiler is not critical to the present invention, and that numerous conventional devices commonly employed with regular or packaged boilers are not shown, or at least not shown in intricate detail so that the features of the present invention can be better and more clearly appreciated. It shall also be noted that the terms "upstream" and "downstream" are used in this application to describe positional relationships between one element or component of the system and another. With respect to FIG. 1, arrows 15 point "downstream" (in this case, to the left).

Figure 2:
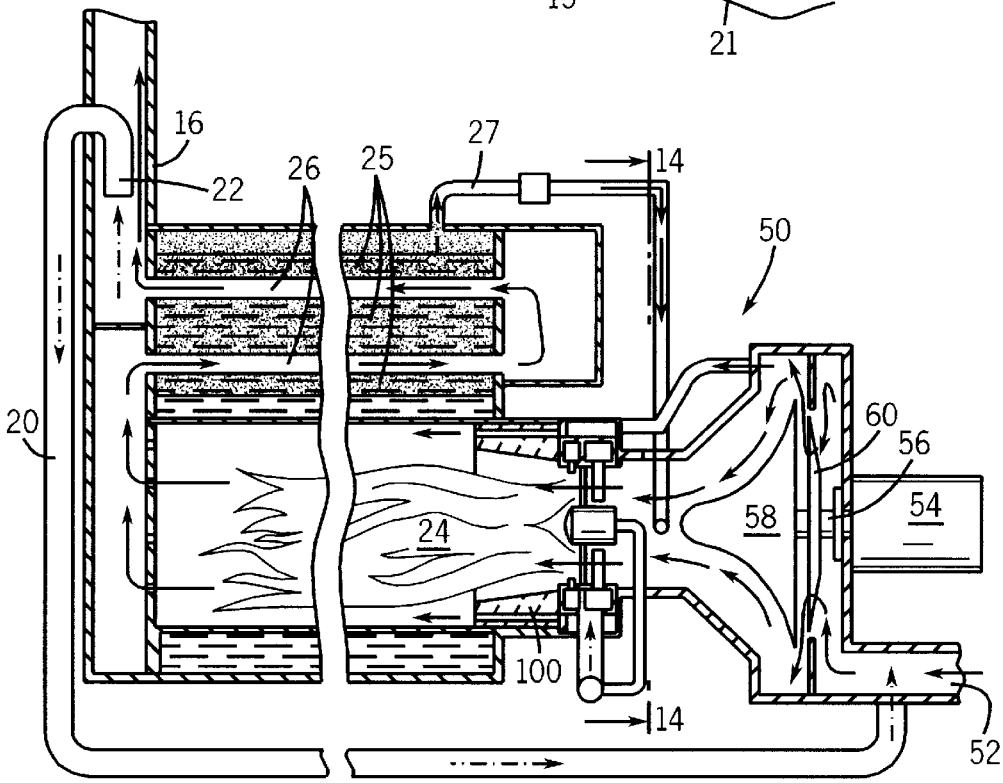
FIG. 2 is a schematic cross-sectional side view of the boiler and burner system of FIG. 1.

Referring to FIGS. 1 and 2, boiler 10 includes a generally cylindrically-shaped boiler housing 12. An exhaust stack 16 extends from housing 12 of boiler 10 to discharge combustion product from a combustion chamber 18 located within the boiler.

Figure 3:
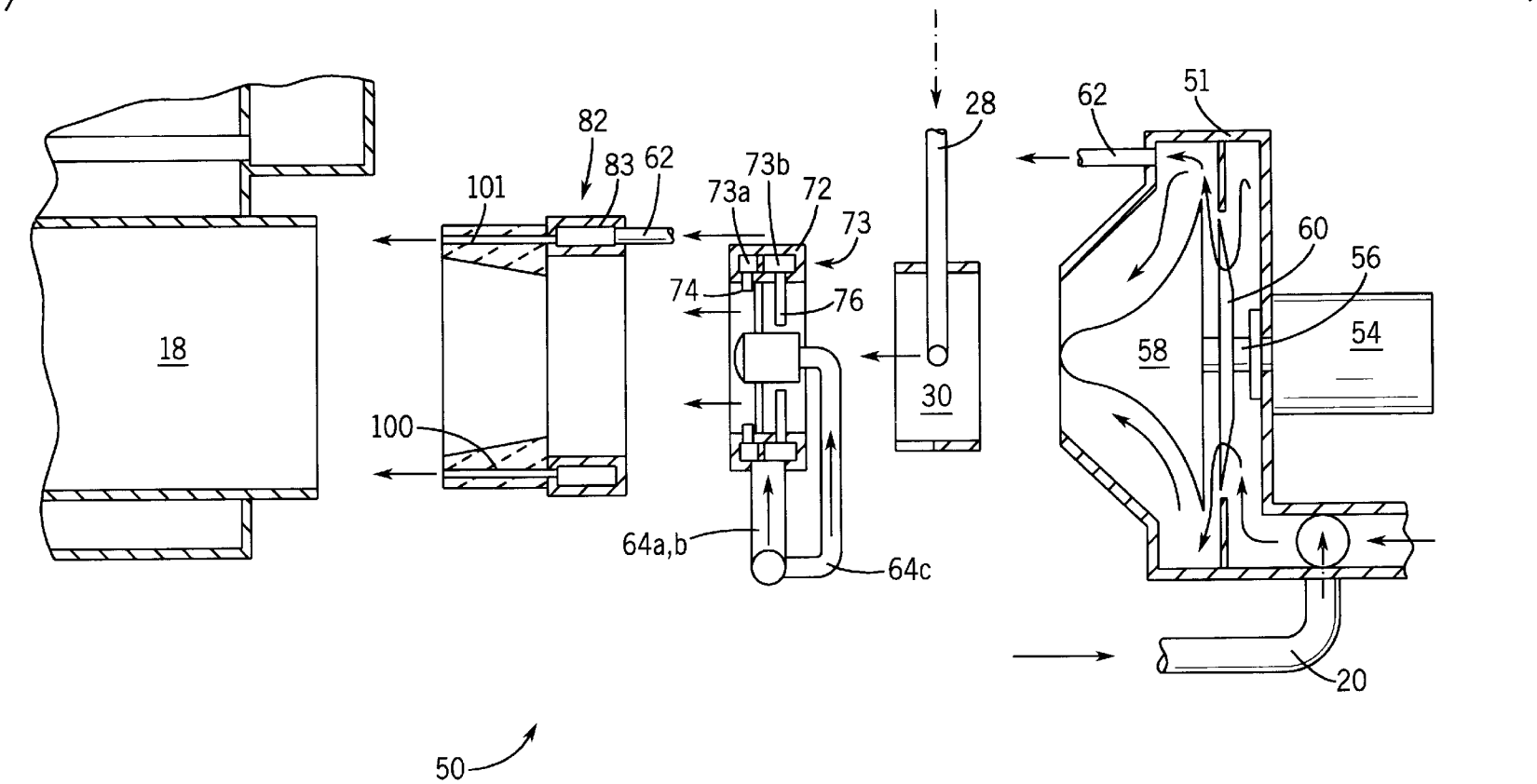
FIG. 3 shows an exploded, partially schematic, partial cross-sectional view of the burner system of FIG. 1.
Figure 4:
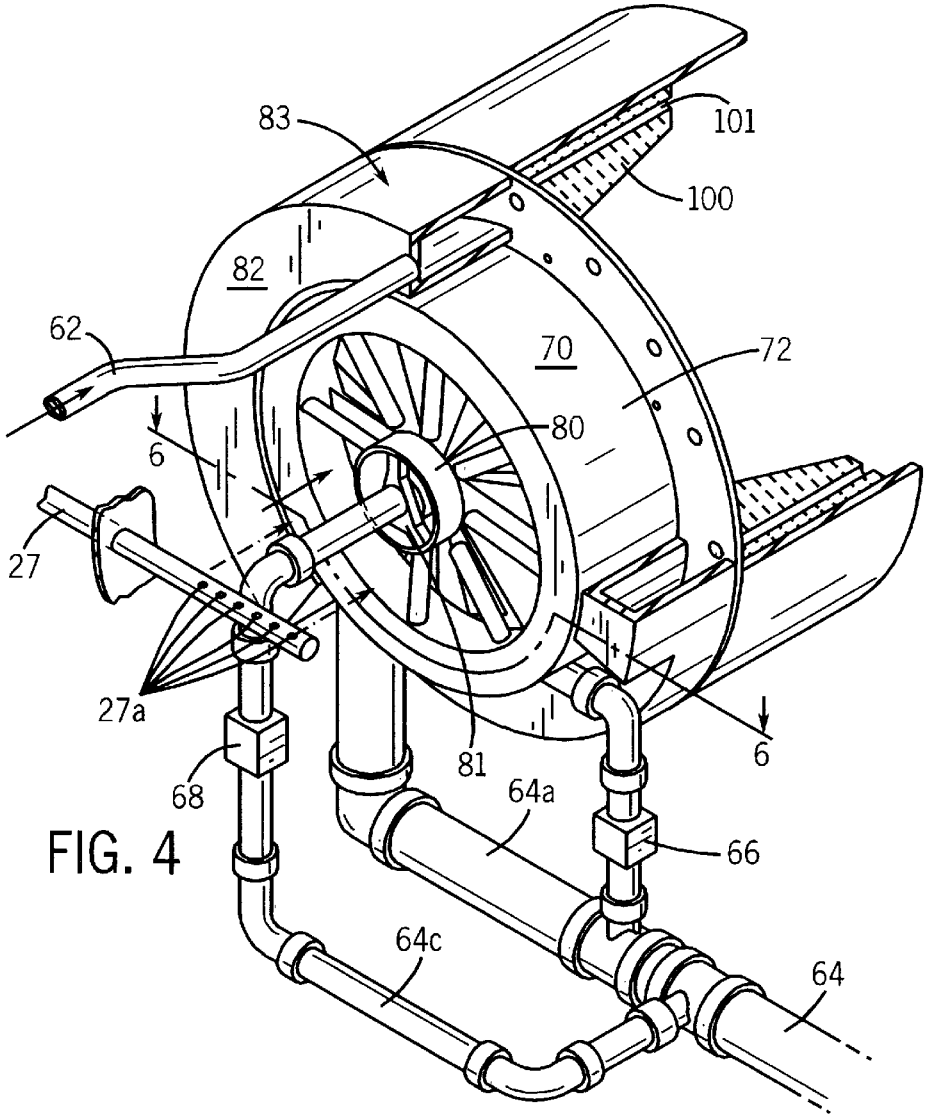
FIG. 4 is a partial perspective view of the burner system.

Turning to FIGS. 3 and 4, a burner 50 can receive a fuel from a fuel source (not shown). Specifically, a fuel line or pipe 64 can be attached to the burner to supply fuel to the burner system. The pipe can be used to provide various fuels, such as, for example, propane and natural gas. With respect to the present invention, the fuel is preferably a natural gas, provided via pipe 64, to the burner in gaseous (rather than liquid) form. A separate delivery system could be utilized to provide oil, if necessary.

Still referring to FIGS. 3 and 4, pipe or fuel line 64 can be divided into fuel branch lines 64*a* and 64*b* to provide fuel to a fuel manifold 70, shown having annular housing 72. The housing defines an interior area 73 for containing the fuel, again for example, natural gas, therein. Fuel manifold 70 can be called a "dual fuel manifold", or simply "dual manifold". This means that can provide independent fuel flow (shown specifically in FIG. 6, described below) from branch fuel lines 64*a* and 64*b*, to a first set of fuel injectors 74 and a second set of fuel injectors 76. Both sets of injectors, as shown here, extend radially inward from manifold housing 72. Injector 76 injects a fuel into an air stream upstream of the diffuser 84, thereby creating a pre-mixture, or simply "pre-mix" of fuel and air.

Figure 6:
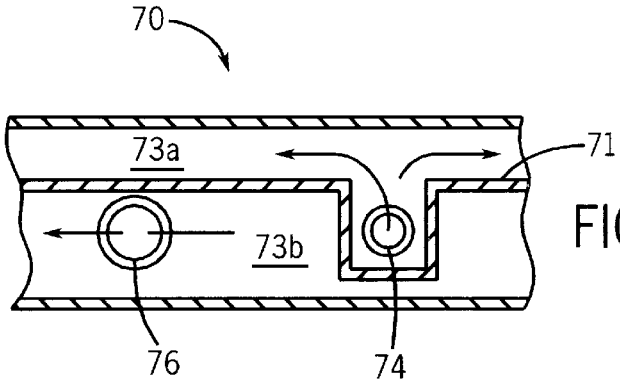
FIG. 6 is a partial cross-sectional view taken along line 6—6 of FIG. 4.

FIG. 6 is a partial cross-sectional view of fuel manifold 70 is shown, better illustrating the manner in which the manifold permits, by way of housing 72 (FIG. 3) and separating wall 71, fuel to flow independently to injectors 74 and 76. Separating wall 71 creates individual chambers 73*a* and 73*b* in interior area 73.

Figure 7:
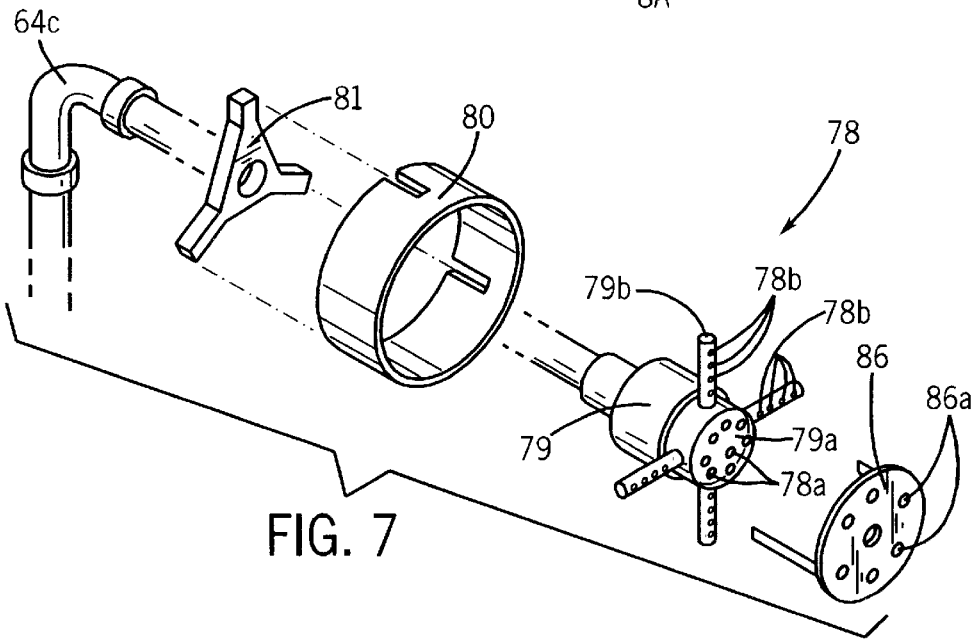
FIG. 7 is an exploded view showing several components of the burner system illustrated in FIG. 4.

Again referring to FIGS. 3 and 4, and additionally the exploded view of FIG. 7, branch fuel line 64*c* provides fuel to centrally disposed injectors 78*a*, and 78*b* (collectively 78) disposed on base 79 located downstream of rim 80. Rim 80 itself is disposed within an interior cylindrical area defined by housing 72 of manifold 70. Further, rim 80 is connected via spoke 81 to fuel line 64*c*. Fuel line 64 preferably includes valves 66 and 68 (for instance, butterfly or modulating valves) on branch lines 64*a* and 64*c*, along with cam trim 140 (discussed in detail below with reference to FIG. 13). These features can regulate the fuel pressure and permit precise control of fuel flow rates to each respective destination, namely, in the case of the present invention, fuel to injectors 74, 76, and 78 (injector 78 is shown in FIG. 7).

Turning again to FIGS. 1 and 2, a burner system 50 having housing 51 is provided, the burner connected to combustion chamber 18. Recirculation tube 20 recovers combustion product (i.e., exhaust) such as flue gas in the form of a moist heat via a pick up line 22 connected to exhaust stack 16. Some of the combustion product is then returned to burner 50 via recirculation tube 20. Combustion chamber 18 provides an area for flame 24 (FIG. 2) to heat, for instance, a chamber 25 utilized for containing a liquid, such as water using plurality of fire tube pipes 26. A heat exchanger (not shown) can be attached to tube 20 to lower $NO_x$ emissions and also to accomplish, among other things, pre-heating of feedwater, pre-heating of a room, or simply heating water.

Burner system 10 also includes a steam injection system having steam pipe 27 (see FIG. 14) for reintroducing steam from boiler 12 to mixing chamber 30 (also called a "blast tube") of burner 50. Steam injection is discussed in greater detail with respect to FIG. 14.

Figure 5A:
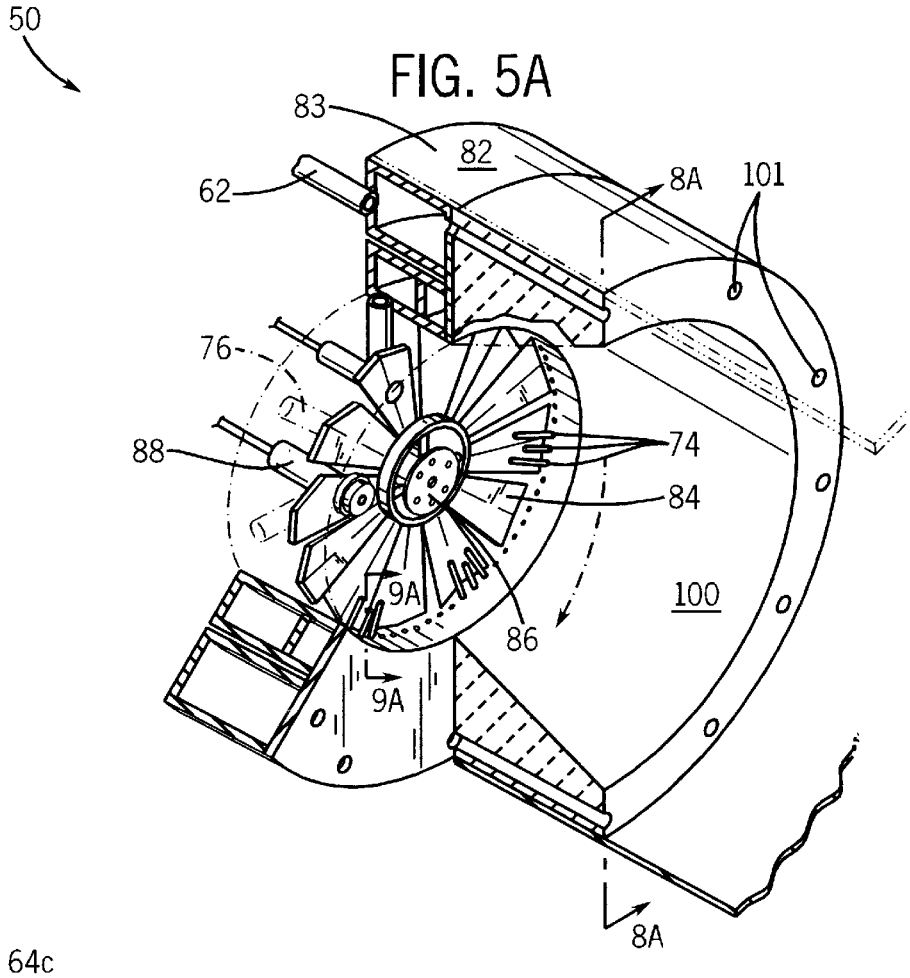
FIGS. 5A and 5B are partial perspective views of the burner system.
Figure 16:
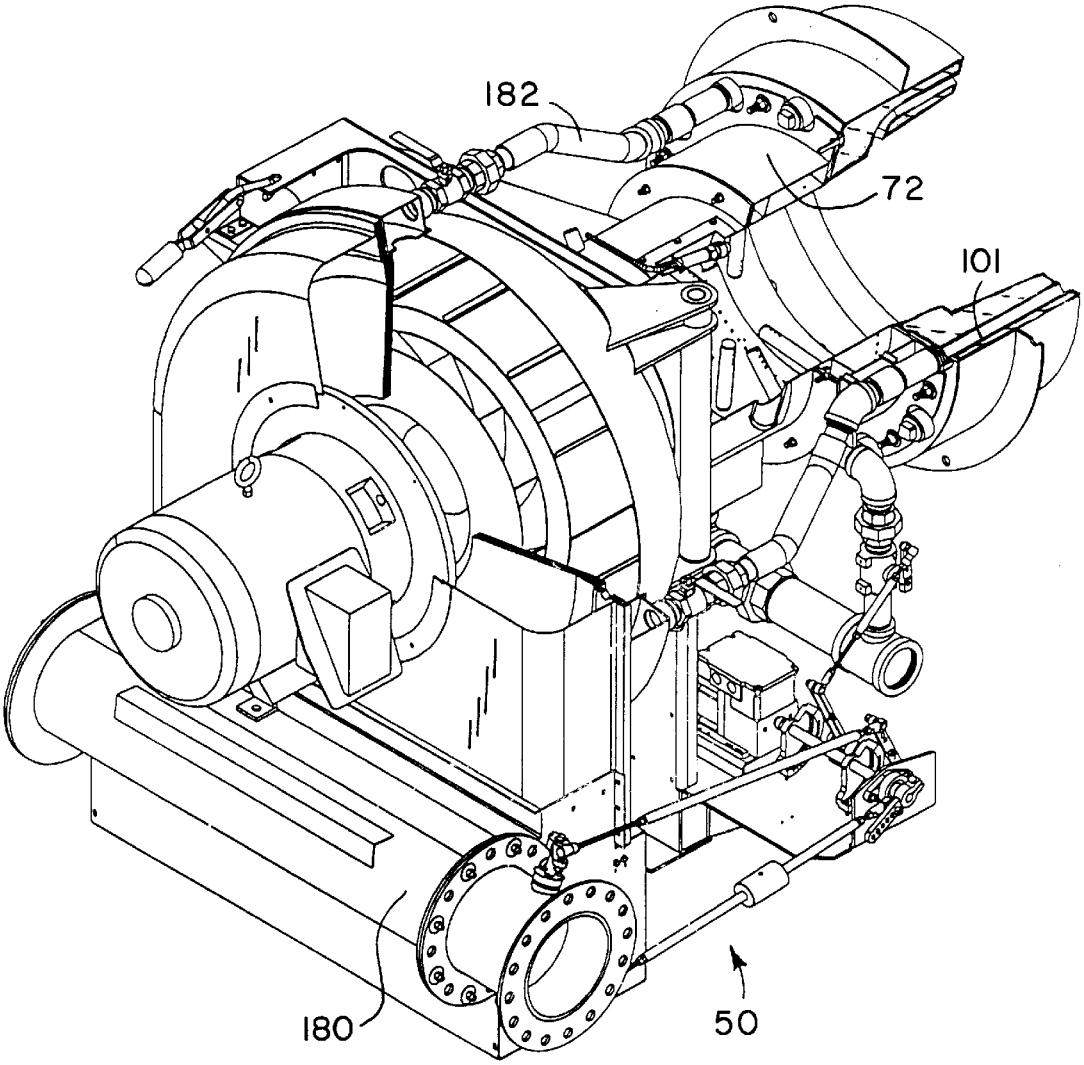
FIG. 16 shows a partial perspective, partially schematic view of the burner system.

FIGS. 5A and 5C illustrate partial perspective views of burner system 50 (see FIG. 16). Again, manifold 82, located upstream of refractory 100, can permit combustion air and recirculated combustion product to bypass the fuel manifold 72 and flow directly through the refractory via channels 101. Fan-like diffuser 84 can function to provide flame retention downstream of the diffuser, particularly in an area around fuel injectors 74. As shown, diffuser 84 is disposed between the first set of injectors and the second set of injectors. Disk-shaped diffuser 86 can be included and can function similarly with regard to injectors 78*a* and 78*b* on face 79*a* and extensions 79*b* respectively. Diffuser 86 can comprise holes 86*a* (shown in FIG. 7).

Figure 5B:
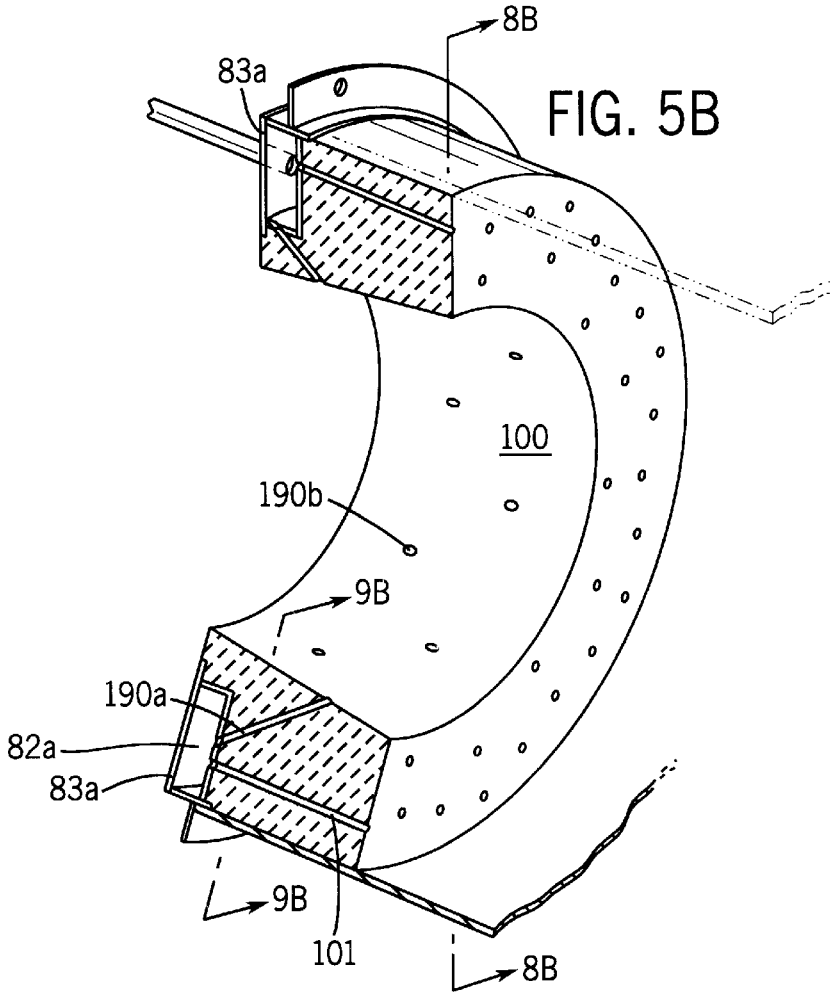

Referring to FIG. 5A, burner 50 includes pilot 88 to light the main flame and operate in conjunction with injectors 74, 76, and 78 (FIG. 7). FIGS. 5A and 5B both show a tapered cross-section of refractory 100.

However, referring specifically to FIG. 5C, another preferred embodiment is shown. In FIG. 5A, the refractory has a smooth, frustoconical profile, widening in diameter as it opens into the combustion chamber located downstream. In this embodiment, refractory 100 includes flat side or "step" 102 (see FIG. 8C).

Figure 8A:
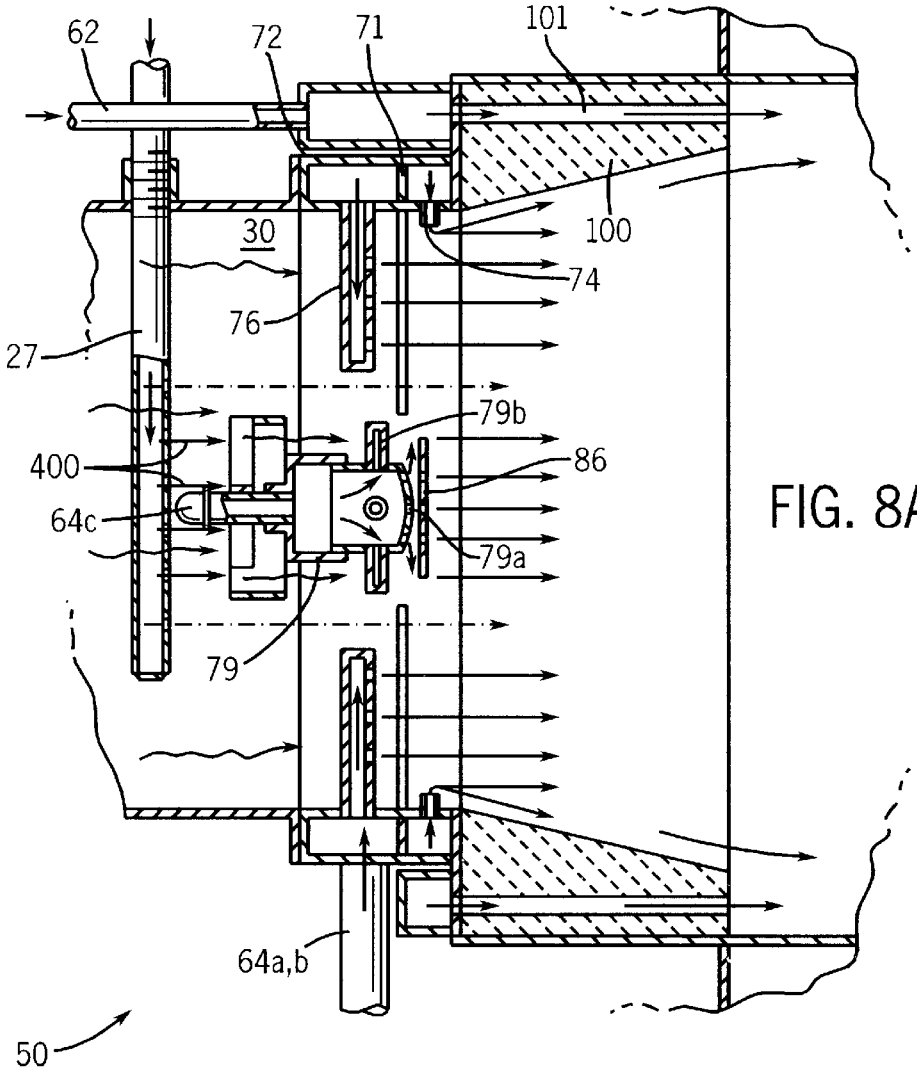
FIG. 8A is a partial cross-sectional view of the burner system taken along line 8A—8A of FIG. 5A.
Figure 8B:
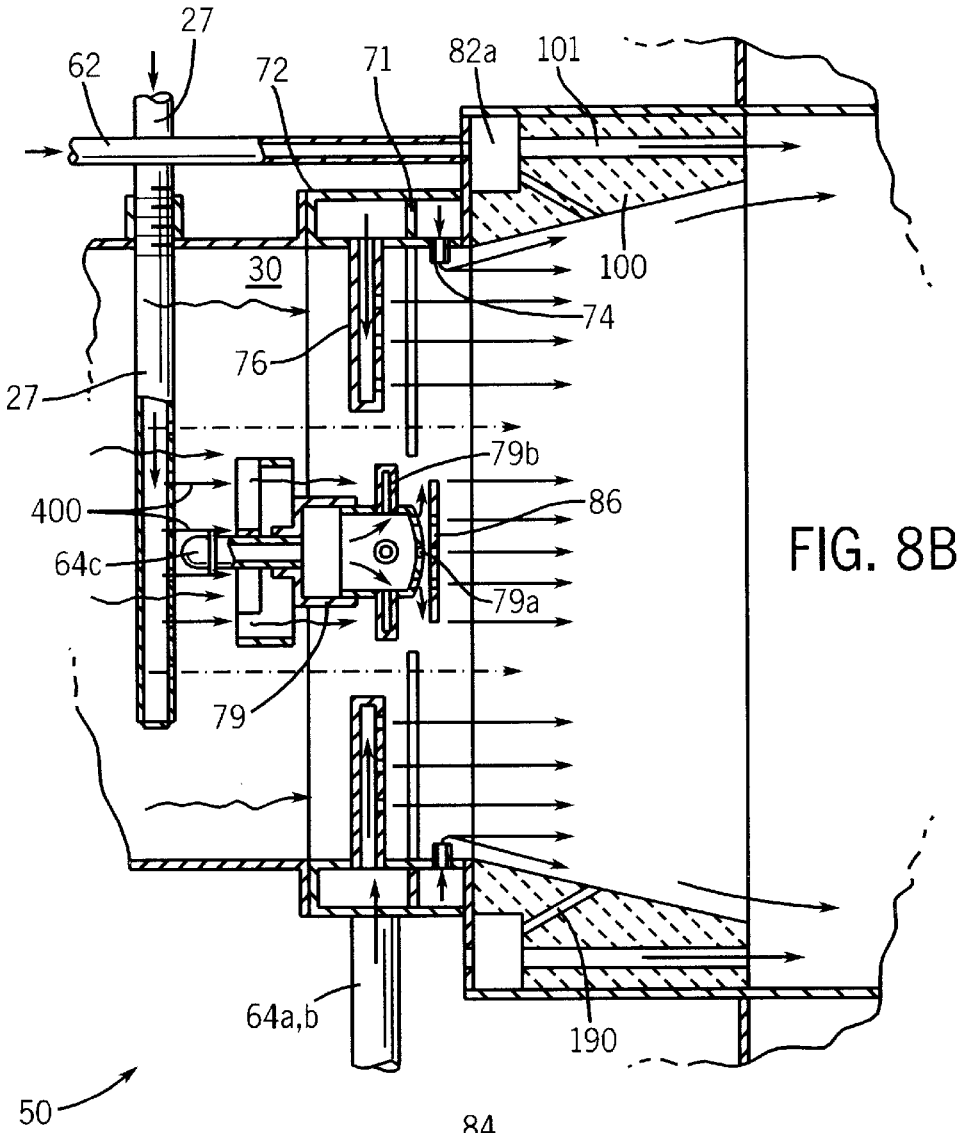
FIG. 8B is a partial cross-sectional view of the burner system taken along line 8B—8B of FIG. 5B.
Figure 8C:
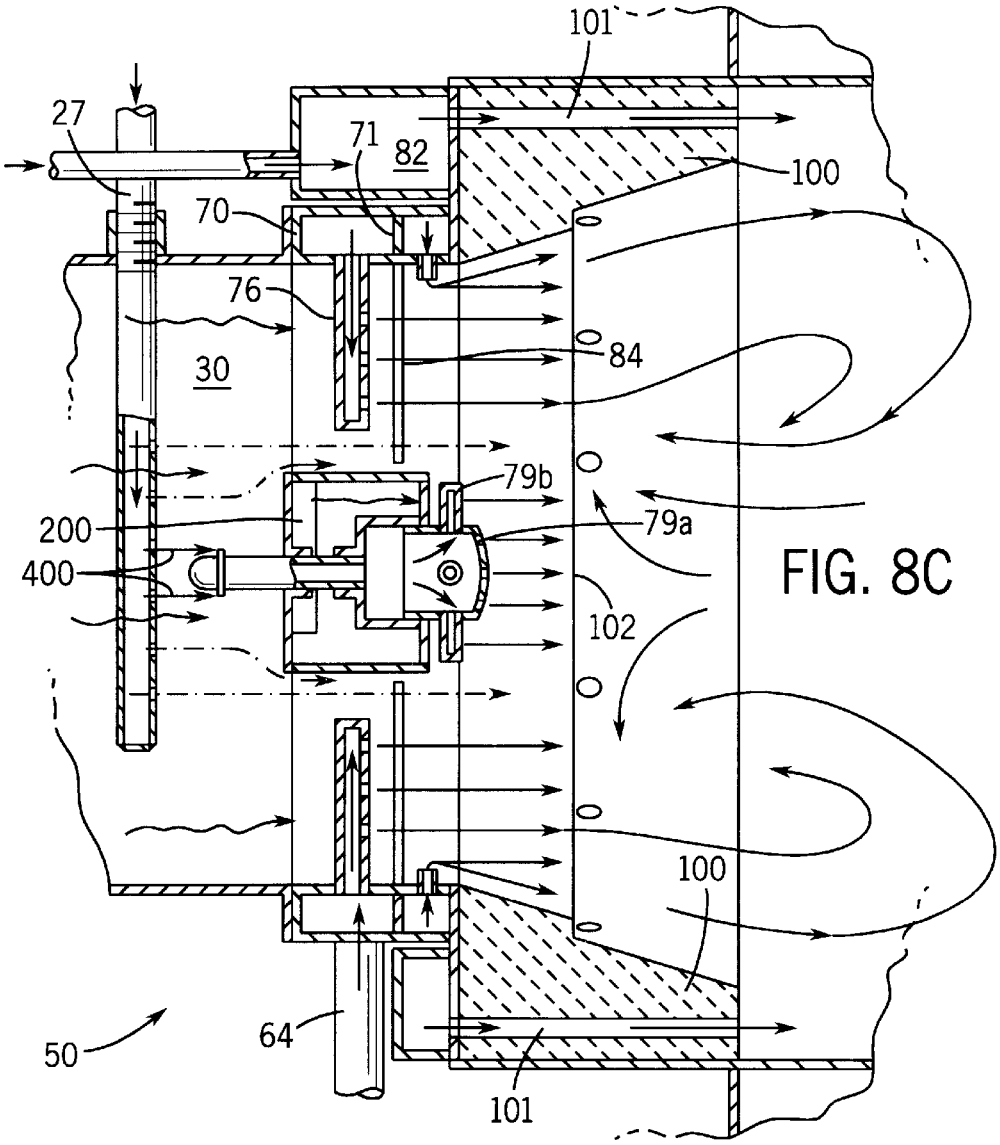
FIG. 8C is a partial cross-sectional view of the burner system taken along line 8C—8C of FIG. 5C.

FIGS. 8A–8C show partial cross-sections of FIGS. 5A–5C respectively. Air, as before, enters the burner and flows past steam pipe 27, which passes steam downstream. As described earlier, air and recirculated combustion product are also passed downstream via tube 62 which passes through duct 82 having housing 83, and on through refractory 100 into combustion chamber 18 via channels 101. Fuel generally passes through fuel line 64. More specifically, branch line 64*c* permits fuel to flow past steam pipe 28, while branch lines 64*a* and 64*b* provide fuel to the fuel manifold 70, having housing 72. Separating wall 71 permits the independent adjustment of fuel flow to injectors 74 and 76. Separately, fuel line 64*c* delivers fuel to injectors 78*a* and 78*b*, centrally located within the burner. Diffusers 84 and 86 are shown in FIG. 8A, while in FIG. 8B, diffuser 86 is absent.

With specific regard to FIG. 8C, refractory 100 includes "stepped" sidewall 102, at the base of which are arranged channels 104. Channels 104 provide for internal recirculation of combustion product, further increasing burner efficiency by recirculating, and thus reducing, waste that is normally lost to stack 16. Center block 200 also may be blocked so as to create a pressure difference that creates internal recirculation as shown.

As shown in FIGS. 8A–8C, steam flow, shown by arrows 400 enters burner 50 via tube 27 at a plenum or chamber 30. Steam injection (see FIG. 14 for additional detail) can be controlled by a variable flow control valve connected to the same jack shaft as the other components. Steam flow can utilize cam trim 140 (described below with reference to FIG. 13. It is noted that face 79*a* is preferably flush with diffuser 84 as shown in FIG. 8A.

Figure 9A:
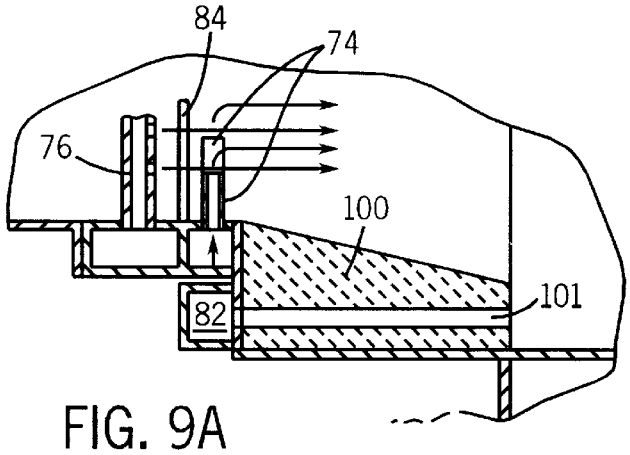
FIG. 9A is a partial cross-sectional view taken along line 9A—9A of FIG. 5A.

FIG. 9A illustrates a partial cross-sectional view of FIG. 8A. Along with fuel injectors 74 and 76, diffuser 84 is shown. Refractory 100 is shown comprising channels 101. As depicted, channel 101 permits combustion air and recirculated combustion product to pass from duct 82 to the combustion chamber.

Figure 9B:
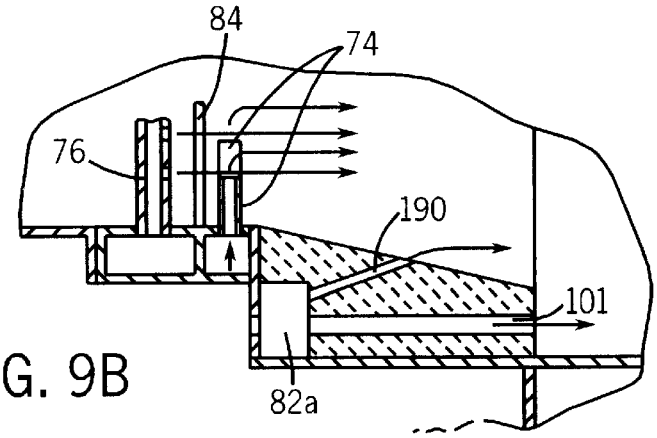
FIG. 9B is a partial cross-sectional view taken along line 9B—9B of FIG. 5B.

FIG. 9B illustrates a partial cross-sectional view of FIG. 8B. Along with fuel injectors 74 and 76, diffuser 84 is shown. Refractory 100 is shown comprising the two types of channels, axial channels 101 (shown in FIG. 9A) and radial channels 190 (described further with respect to FIGS. 5B and I5 below). As depicted, channel 101 permits combustion air and recirculated combustion product to pass from duct 82*a* to the combustion chamber. Duct 82*a* is internal to the refractory, which improves sealing of air and combustion product between burner 50 and refractory 100. Channels 190 permit air and recirculated combustion product to be passed from duct 82*a* to the combustion chamber. The two types of channels function in combination to improve overall burner efficiency.

Figure 9C:
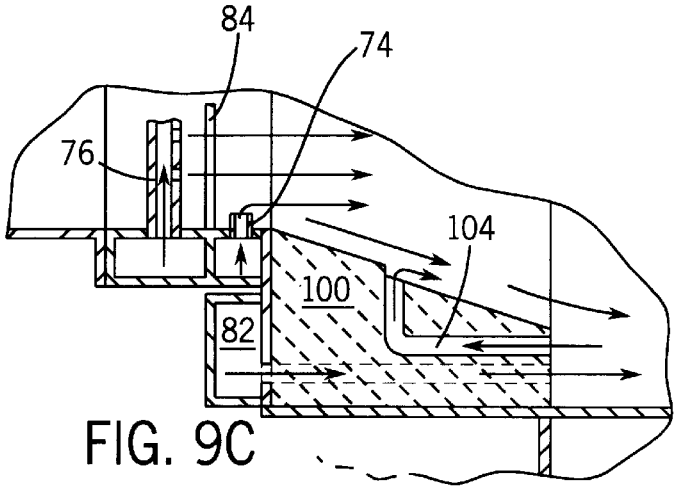
FIG. 9C is a partial cross-sectional view taken along line 9C—9C of FIG. 5C.

FIG. 9C illustrates a partial cross-sectional view of FIG. 8C. Along with fuel injectors 74 and 76, diffuser 84 is shown. Refractory 100 is shown comprising the two types of channels 101 and 104 described previously. As depicted, channel 101 permits combustion air and recirculated combustion product to pass from duct 82 to the combustion chamber. Channel 104 permits recirculated combustion product to be recirculated back through the refractory to be combusted again, thus improving efficiency.

FIGS. 10–12 and 15 are partial schematic views of boiler 10, FIG. 1 illustrating various flame configurations resulting from the provision of different refractories. These refractory shapes are exemplary of preferred embodiments of the present invention. Other refractory shapes and designs are contemplated and are within the scope of the present invention.

Figure 10:
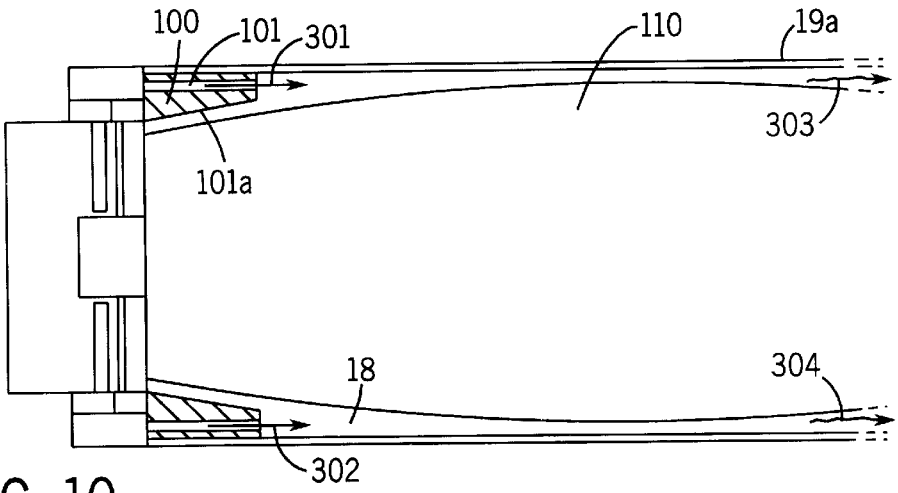

FIG. 10 illustrates a refractory 100 that comprises channel 101 (of which a plurality are typically spaced, for instance circumferentially, around the refractory) permits air and recirculated combustion product to flow, as indicated by arrows 301–304 through the refractory and into combustion chamber 18 so as to shape flame 110. Air and recirculated combustion product flow can provide the added benefits of CO reduction and a cooler flame.

Figure 11:
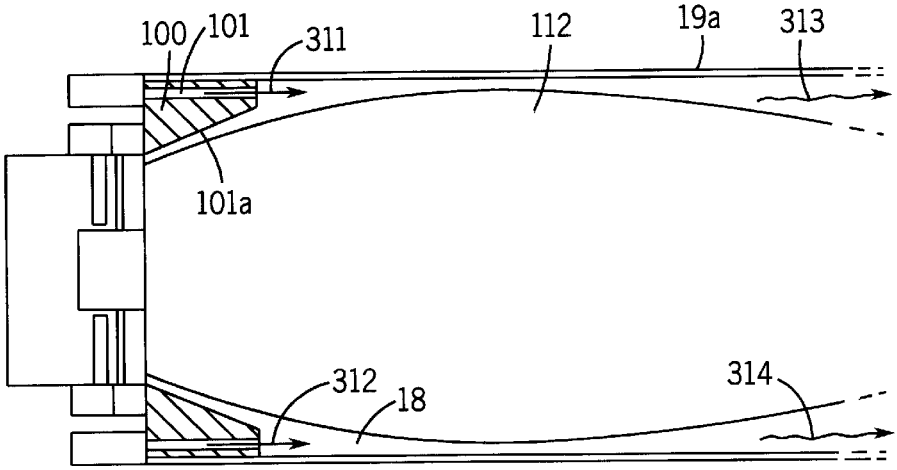

FIG. 11 illustrates an arrangement similar to that of FIG. 10, except that the surface 101*a* of refractory 100 includes tapered to a greater extent. This change results in a different flame 112 shape by controlling the air flow in surrounding relation to the flame, as illustrated by arrows 311–314.

Figure 12A:
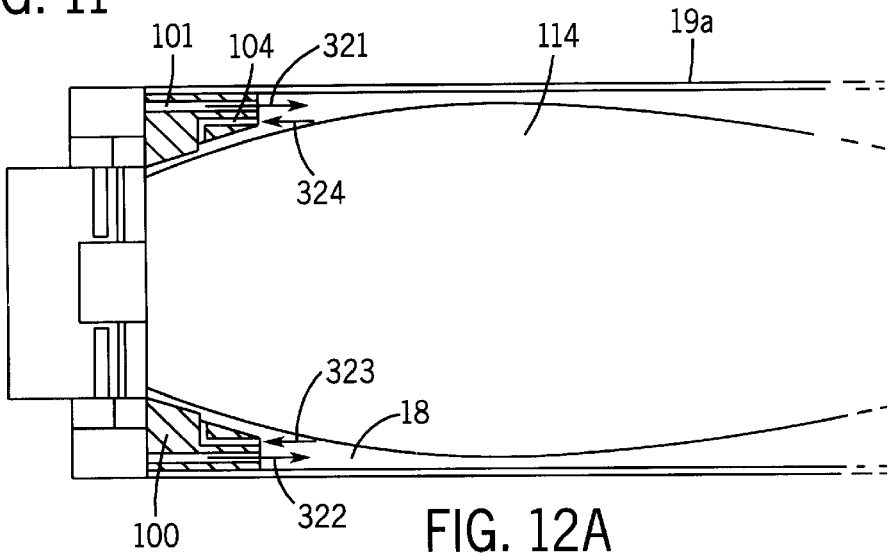

FIG. 12A illustrates a partial schematic cross-sectional view of the burner 50, and more specifically, the "stepped" refractory 100, shown and described earlier with reference to FIGS. 5C and 8C. Flame 114 can be shaped using secondary air and recirculated combustion product passing through channel 101, as indicated by arrows 321–322. Additionally, channels 104 can provide, as indicated, for internal recirculation of combustion product upstream, indicated by arrows 323–324, from combustion chamber 18, which could result in lower $NO_x$ and CO emissions.

With respect to FIG. 5B, tapered or wide included angle refractory 100 is shown comprising radial channels 190 and axial channels 101, both for passing air and recirculated combustion product. Radial channels can vary in their angling, as is illustrated by 190*a* and 190*b*. In an alternative preferred embodiment, the angled channels to deliver some combustion air, recirculated combustion product, or some other gaseous fuel (or a mixture of one or more of the previously mentioned materials) to the tapered side of the refractory. Such radial channels could be used to accomplish different staging in a given product. Refractory 100, as shown, comprises internal by-pass manifold 82*a* (as opposed to the external manifold shown in FIG. 5A) defined by housing 83*a*. The manifold located within the refractory (called an "internal refractory manifold") is used to control the level or rate at which air and/or combustion product is passed through the refractory. The internal refractory manifold can also be seen in detail in FIG. 8B.

Figure 15:
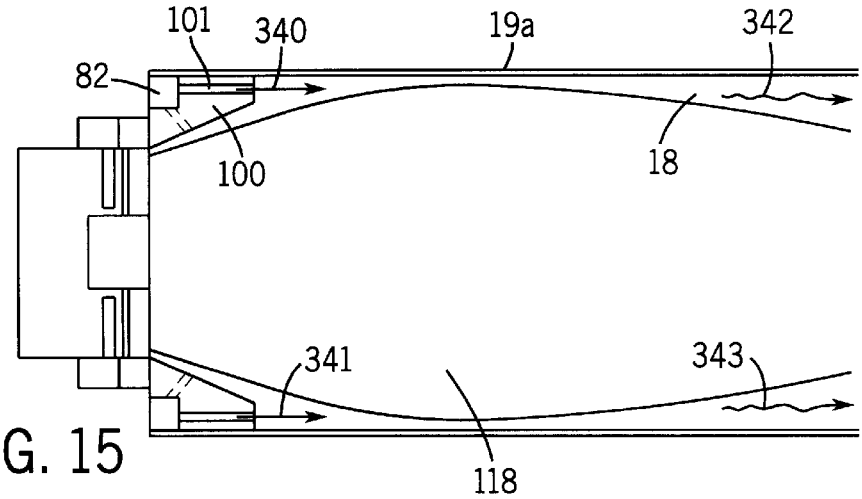
FIGS. 10–12 and 15 are partial schematic cross-sectional views of the burner system illustrating various flame configurations in accordance with various aspects of the invention.

FIG. 15 illustrates a partial schematic cross-sectional view of the burner, in particular, the embodiment of the refractory for the burner of FIG. 5B. As shown flame 118 can be shaped in the combustion chamber and wall 19*a* cooled using secondary air recirculated combustion product passing through channels 101 (the flame-shaping shown by arrows 340–343). Additionally, angled channels (shown in dashed lines) can be used to deliver some of the combustion air, recirculated combustion product, and/or gaseous fuel (or a mixture thereof) to the tapered side of the refractory from plenum or manifold 82*a* housed within refractory 100. This too can be used to control the shape of flame 118.

The features shown in FIGS. 10–13 and 15 illustrate the manner in which, given the specific geometry of a vessel (e.g., a combustion chamber) and a refractory, a flame can be shaped. Additionally, control of flow rates such as recirculated combustion product, air and fuel can provide a flame that result in reduced pollution emissions.

Figure 12B:
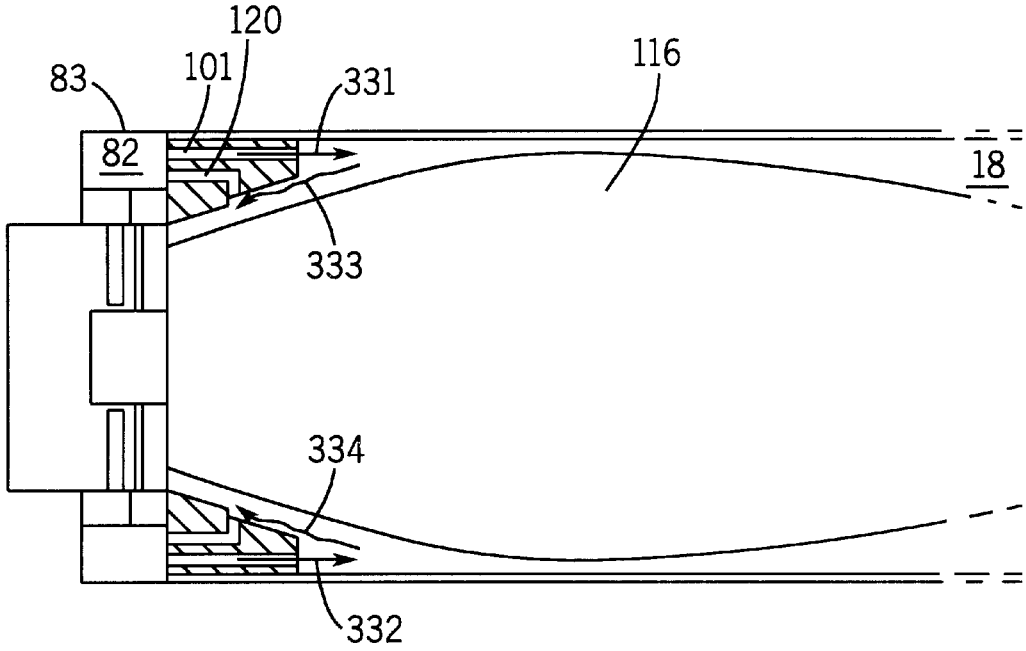

FIG. 12B shows air and recirculated combustion product being passed through channel 101. This is illustrated by arrows 331, 332. Internal recirculation of some combustion product and air from downstream of refractory 100 back upstream to duct 82 through channel 120 is also shown using arrows 333, 334. This too provides an alternative way to shaping flame 116.

Figure 13:
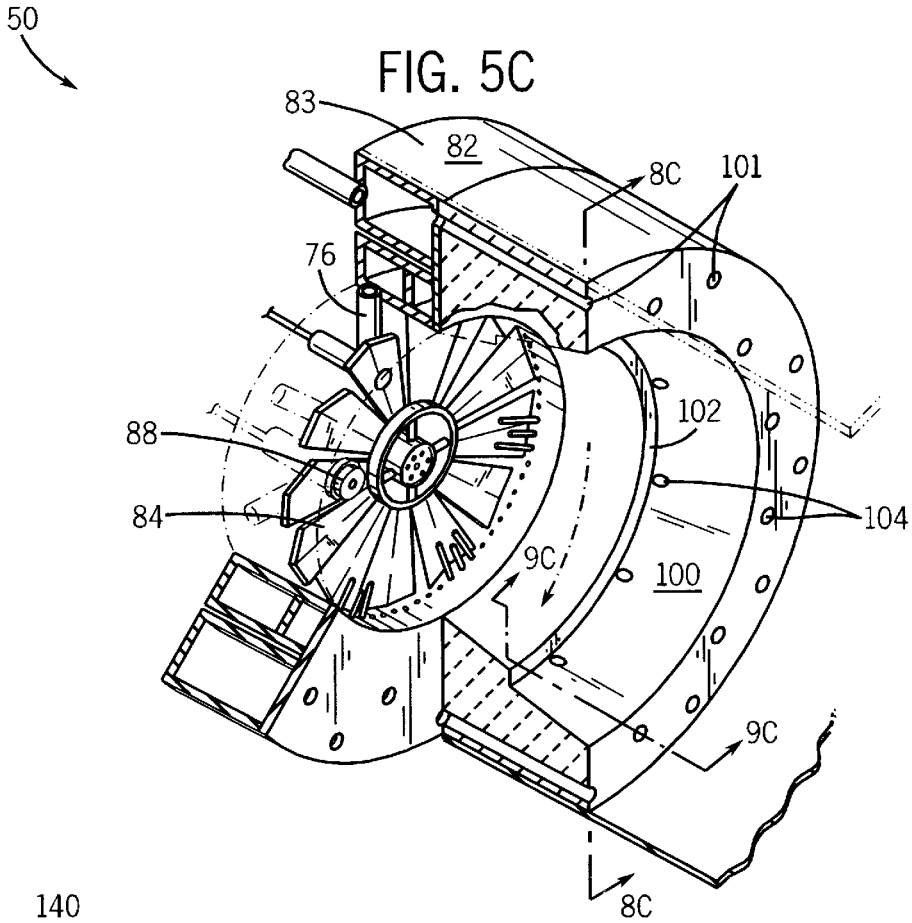
FIG. 13 illustrates cam trim for fine adjustment of, for example, fuel and air.
Figure 13:
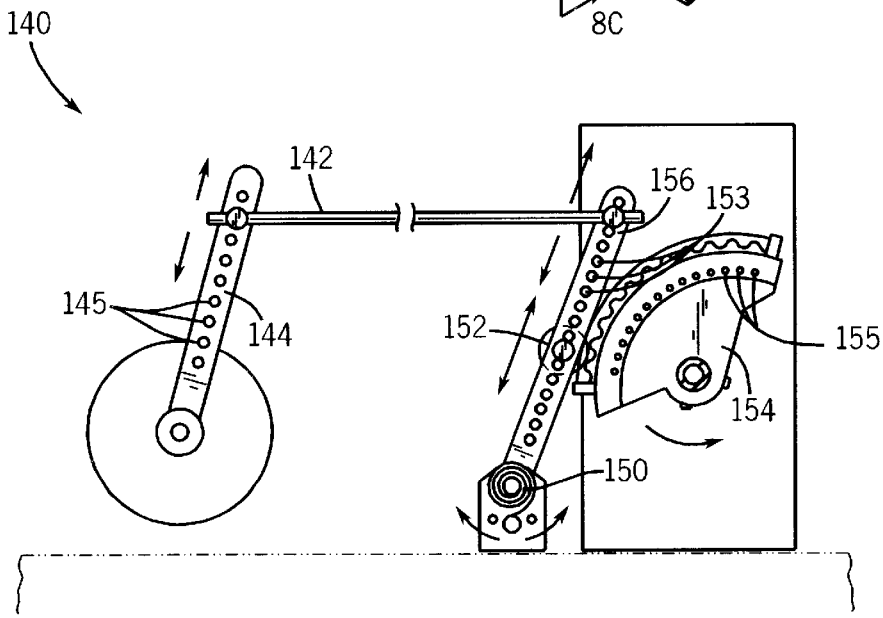

FIG. 13 illustrates cam trim 140 for fine adjustment of, for instance, air, fuel and recirculated combustion product flow amounts and rates. Cam trim 140 includes linkage arms 144 and 156. Arm 144 includes settings 145 and linkage 142 connected to fuel metering device (not shown), for example, a butterfly valve. Arm 156, utilizing spring 150 and roller guide 152 having adjustable settings 153, operates (as indicated by the arrows shown) in conjunction with cam trim adjustor 154 which comprises multiple settings 155. Using settings 155, set screws may be adjusted to permit, for example, an increase or decrease in fuel level. Alternatively, and without departing from the scope and teachings of the present invention, servo motors, direct linkages, and the like can be used to control the flow of, for example, air, fuel and recirculated combustion product.

Figure 14:
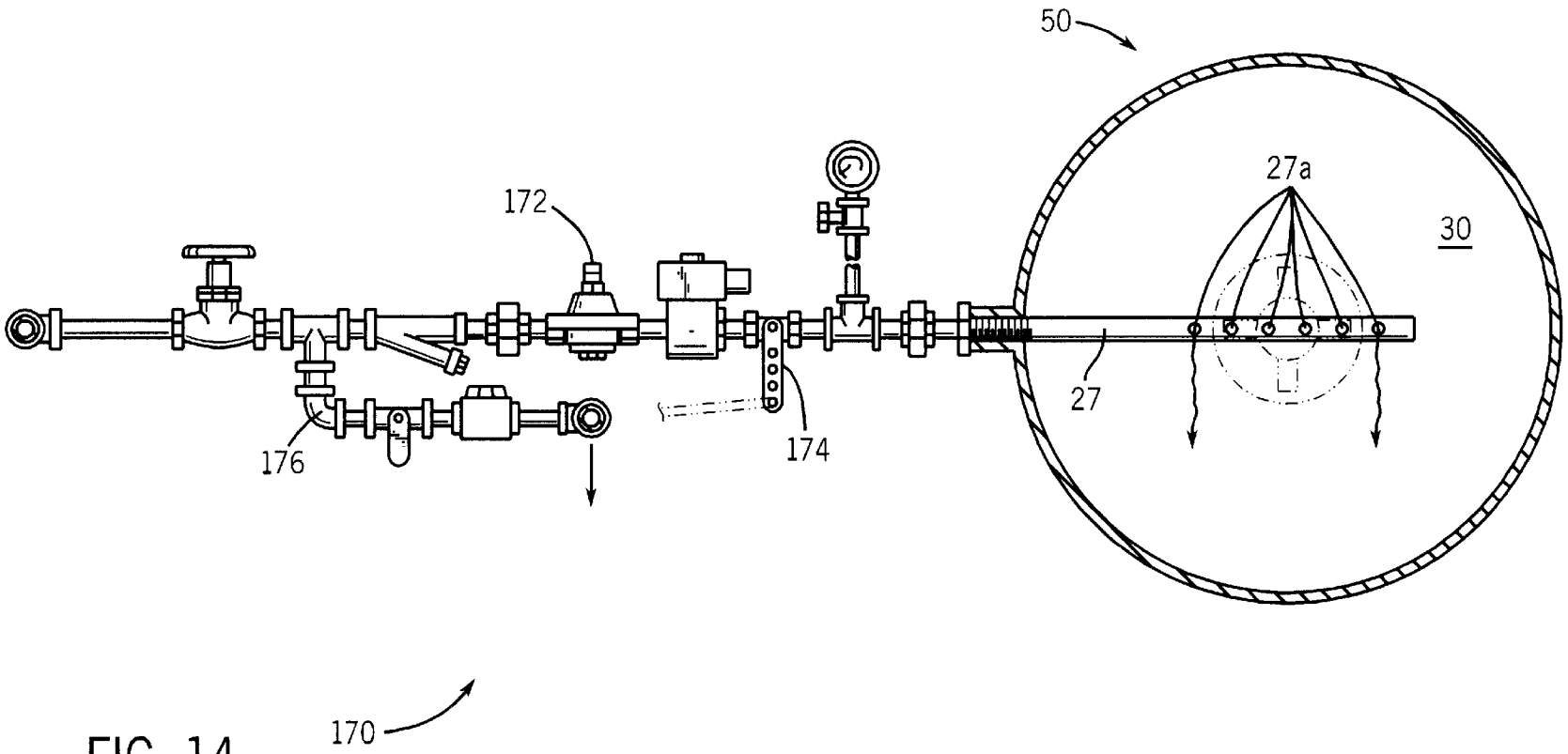
FIG. 14 is a cross-sectional view taken along 14—14 of FIG. 2 that illustrates one embodiment for introducing steam into the burner system.

Referring to FIG. 14, one embodiment of a steam injection assembly 170 for use with burner 50 is shown. Steam is supplied to blast tube area or mixing chamber 30 upstream of the diffuser (not shown). As shown, in assembly 170, steam pressure can be controlled using regulator 172 and steam can be modulated using valve 174, that is connected to a mechanical linkage rod (not shown). Steam is injected, as noted previously, via pipe 27, and more specifically, steam is injected into chamber 30 via injectors 27*a* (collectively). The spacing and number of injectors can vary depending on the size and requirements of given application.

Steam modulation is important because it affects steam quality, and steam quality is a factor in achieving the desired low pollution emission (both $NO_x$ an CO emission) in one or more of the preferred burner embodiments (described further below). Preferably, the steam that is used is a "dry" steam, meaning that the level of condensed steam with in the assembly is kept to a minimum. Condensation can be collected in "drip leg" 176. The entire steam assembly can be controlled off of a jack shaft (not shown) which is common to other modulating valves.

Significantly, the mixing chamber used in the present invention can be provided as an add-on or upgrade to existing burners and burner-boiler systems since can be attached without welding.

Water injectors (not shown) can be used in place of the steam injectors for hot water and non-steam applications. In such cases, water is typically applied in a finely atomized or foggy type spray. Again, the water injectors would preferably be located upstream of the first set of fuel injectors. Of course, the quantity and position of the water injectors would vary based upon the application at hand.

FIG. 16 illustrates another preferred embodiment of the present inventive burner system. Burner system 50 comprises fuel manifold 72 as before. Air and recirculated combustion product can be passed, using profiled rotary damper 180, through hoses 182 past manifold 72 to refractory 100. The air and combustion product can then be passed to and through the refractory, via channels 101.

In operation, recirculated combustion product is captured from emissions stack 16 returned via pipe 20 to the profiled rotary damper assembly (not shown) in burner 50. The amount of recirculated combustion product is controlled by a modulating butterfly valve (FIG. 16) which itself is controlled from a common jack shaft (partially shown in FIG. 16) having a mechanical linkage and utilizing cam trim 140 (shown and described with reference to FIG. 13). The same jack shaft assembly controls combustion air with a separate linkage arm also having cam trim. An operating control switch (not shown) closes and starts fan 60. Fan 60 continues to run during pilot trial and main frame ignition. A flue gas analysis system with feedback may be incorporated to better control fuel, air, and recirculated combustion product ratios. This arrangement can include separate recirculated combustion product blower to control the firing rate with the combustion chamber along with parallel positioning controls. In this case, valve 21, for instance, a modulating valve (see FIG. 1), can be electronically linked to the burner firing rate, rather than mechanically.

Also, parallel positioning and variable speed drives (not shown) could be incorporated without departing from the goals of the present invention, to achieve certain benefits, for instance, energy savings. In such instances, another motor (not shown) can be included to drive a separate recirculated combustion product blower (not shown).

Referring again to FIGS. 2 and 3, burner 50 receives recirculated combustion product (also called flue gas) via a tube 20, steam from boiler 10 via pipe 27, and ambient air shown generally at 52, via for instance, a rotary air damper (FIG. 16). Preferably, a motor 54 drives a fan 56 (also called an impeller) to propel the air, steam and recirculated combustion product through burner 50. Preferably, a burner diffuser 84 (described below with respect to FIGS. 5A and 5B) and an air straightener (also called a stator cone) 58 are located within the burner to produce proper air flow to achieve complete, or near complete, combustion within chamber 18. As shown, air and recirculated combustion product are drawn past impeller 60 and through mixing chamber 30.

Results

Below are tables that illustrate pollution emission data for various burner designs. Each of the tables includes a numerical breakdown of Flue Gas or post-combustion gas readings. Specifically, the emission data comprises the amount of $O_2$ remaining in post-combustion air and $CO_2$ that is created due to combustion, with each component measured as a percentage, by volume of the flue gas. In addition, measurements of CO, NO, $NO_2$, $NO_x$, are included, with each of these emissions measured in parts per million on a volume basis (referred to as "ppmv" or simply "ppm).

$NO_x$ emission levels (ppm) are corrected to 3% $O_2$ levels in accordance with accepted practices in the burner burner-boiler industries.

Such pollution emission data, in general, is used to define the "quality of combustion", and the data is utilized by, for example, standard-setting organizations, for instance SCAQMD, and potential equipment suppliers and purchasers. Such third party sources use the data to ensure that the equipment, in this case the specific burner, is operating properly, meaning for example, burner emission levels are within the prescribed limit.

Data measurements were taken from a "standard low Nox burner" and three preferred embodiments of the inventive burner. Readings were taken at a Low Fire, Mid Fire and High Fire range for each of the burner embodiments, respectively. Low Fire (also called "Low Firing Rate"), Mid Fire and High Fire are terms of art that refer to the amount of heat being input or provided by a given burner. Specific numerical ranges can vary depending on the application at hand, for example, whether the burner is being attached to a boiler or some other apparatus, the size of the boiler or other apparatus, and the like.

TABLE 1

| Standard Burner | Low Fire | Mid Fire | High Fire |
|---|---|---|---|
| $O_2$ % | 7.2 | 6.1 | 3 |
| $CO_2$ % | 7.7 | 8.3 | 10 |
| CO ppm | 0 | 0 | 98 |
| NO ppm | N/A | N/A | N/A |
| $NO_2$ ppm | N/A | N/A | N/A |
| $NO_x$ ppm | 21 | 26 | 23 |
| $NO_x$ ppm @ 3% $O_2$ | 27.4 | 31.9 | 23 |

The "Standard Burner" comprises a single set of fuel injectors (e.g., fuel injectors 74). Table 1 shows that CO emissions are 98 ppm in the burner High Fire range and are zero at the low and mid fire ranges. $NO_x$ emissions, when corrected for oxygen ($O_2$) levels of 3%, are 27.4 ppm at the Low Fire burner range, 31.9 ppm at the Mid Fire range to 23 ppm at the High Fire range.

TABLE 2

| First Preferred Embodiment | Low Fire | Mid Fire | High Fire |
|---|---|---|---|
| $O_2$ % | 5.3 | 4.5 | 2.2 |
| $CO_2$ % | 8.7 | 9.2 | 10.5 |
| CO ppm | 0 | 0 | 28 |
| NO ppm | N/A | N/A | N/A |
| $NO_2$ ppm | N/A | N/A | N/A |
| $NO_x$ ppm | 14 | 20 | 19 |
| $NO_x$ ppm @ 3% $O_2$ | 16 | 21.8 | 18.1 |

Table 2 illustrates a first preferred embodiment for a burner comprising a single set of fuel injectors (e.g., fuel injectors 74) and a second set of fuel injectors (e.g., fuel injectors 76). As noted above, the first and second sets of injectors can be independently controlled via a dual gas manifold (e.g., manifold 72). CO emissions are again 0 ppm at the Low Fire and Mid Fire ranges. Significantly, CO emissions are reduced in this embodiment to 28 ppm at the burner High Fire range. $No_x$ emissions, when corrected for $O_2$ levels at 3%, range from a low of 16 ppm at the burner Low Fire range to a high of 21.8 ppm at the burner Mid Fire range. Significantly, the $No_x$ emission level was 18.1 ppm at the High Fire range.

TABLE 3

| Second Preferred Embodiment | Low Fire | Mid Fire | High Fire |
|---|---|---|---|
| $O_2$ % | 4 | N/A | 3.5 |
| $CO_2$ % | 9.5 | N/A | 9.8 |
| CO ppm | 0 | N/A | 0 |
| NO ppm | 14 | N/A | 13 |
| $NO_2$ ppm | 1 | N/A | 1 |
| $NO_x$ ppm | 15 | N/A | 14 |
| $NO_x$ ppm @ 3% $O_2$ | 15.8 | N/A | 14.4 |

In a second preferred embodiment, the burner system comprises a first set of fuel injectors (e.g., fuel injectors 74), a second set of fuel injectors (e.g., fuel injectors 76), a third set of fuel injectors (e.g., fuel injectors 78), and a plurality of channels located in the refractory (e.g., channels 101, 190) for passing air and recirculated combustion gas downstream into the combustion chamber. Significantly, CO emissions are 0 ppm in the Low and High Fire burner ranges. Test data was not available at the Mid Fire range. Moreover, $NO_x$ emission levels, when corrected for 3% $O_2$ levels, are 15.8 ppm at the Low Fire burner range and 14.4 ppm at the High Fire range (again with the mid fire range test data not available).

| Third Preferred Embodiment | Low Fire | Mid Fire | High Fire |
|---|---|---|---|
| $O_2$ % | 2.5 | 3.2 | 1.8 |
| $CO_2$ % | 10.7 | 10.3 | 11.1 |
| CO ppm | 0 | 0 | 6 |
| NO ppm | 9 | 10 | 10 |
| $NO_2$ ppm | 0 | 0 | 1 |
| $NO_x$ ppm @ 7.2% | 9 | 10 | 11 |
| $NO_x$ @ 3% $O_2$ | 9 | 10 | 10 |

Finally, in a third preferred embodiment, a burner system comprises a first set of fuel injectors, a second set of fuel injectors and a third set of fuel injectors, along with a steam injector and an array of refractory bypass channels for introducing air and recirculated combustion product into the combustion chamber. While CO emissions are 6 ppm at the High Fire range (and 0 ppm at the Low and Mid Firing ranges), $NO_x$ levels, when corrected to 3% oxygen levels, result Mid and High Fire burner range levels of 10 ppm. Significantly, $NO_x$ emissions are at a level of 9 ppm at the burner Low Fire range. Lower pollution emission levels, for example, a $NO_x$ emission level of about 8 ppm can be obtained. CO emission levels can vary widely, as they can depend on a variety of factors. For instance, CO emission levels can increase or decrease significantly depending on the boiler (or other apparatus) that the burner is firing into.

The above results are provided by way of example only. Other burner arrangements are possible and within the scope of the present invention. For example one, two or three sets of fuel injector arrangements can operated alone or in combination with a refractory and/or steam/water injector(s) of choice. Only a partial listing of results has been presented.

In conclusion, although the invention has been described in considerable detail through the preceding specification and drawings, this detail is for the purpose of illustration only. Many variations and modifications, including the addition, subtraction and placement of various components of the system, can be made by one skilled in the art without departing from the spirit and scope of the invention as described in following claims.

What is claimed is:

1. A low pollution emission burner system, the burner system comprising:

a fuel manifold comprising a housing, the housing defining an interior area comprising a first chamber and a second chamber;

a first set of injectors for injecting a fuel from the first chamber, the injectors disposed radially inward from the fuel manifold;

a second set of injectors for injecting the fuel from the second chamber into a stream of air to pre-mix the fuel and the air, the second set of injectors disposed radially inward from the fuel manifold;

a third set of injectors for injecting the fuel, the third set of injectors located in an area defined by at least one of the first and the second set of injectors;

a refractory located downstream of the fuel manifold, the refractory comprising a plurality of channels for introducing air and combustion product into a combustion chamber, the combustion chamber located downstream of the refractory; and a steam injector located upstream of the first set of injectors, the steam injector for injecting steam within the burner.

2. A boiler system comprising the burner system according to claim 1.

3. The boiler system of claim 2 further comprising:

an exhaust stack connected to the combustion chamber for expelling combustion product from the boiler; and a recirculation tube attached to the exhaust stack for recirculating at least a portion of the combustion product.

4. The boiler system of claim 2 further comprising:

an exhaust stack connected to the combustion chamber for expelling combustion product from the boiler; and a recirculation tube attached to the exhaust stack for recirculating at least a portion of the combustion product.

5. The burner system of claim 1 wherein the steam injector injects steam into the burner such that the steam is injected across at least one fuel injector.

6. The burner system of claim 1 further comprising cam trim to permit adjustment of a plurality of material flow rates within the burner, the material comprising at least one of: air, water, steam, fuel and combustion product.

7. The burner system of claim 1 wherein the fuel manifold permits independent control of the first and the second set of fuel injectors.

8. The burner system of claim 1 wherein a $NO_x$ emission level of between about 8 parts per million (ppm) and about 30 ppm is achieved.

9. The burner system of claim 1 wherein a $NO_x$ pollution emission level of between about 8 ppm and about 20 ppm is achieved.

10. The burner system of claim 1 wherein a $NO_x$ emission level of between about 8 ppm and about 15 ppm is achieved.

11. The burner system of claim 1 wherein a CO emission level of between about 10 ppm and about 12 ppm is achieved.

12. The burner system of claim 1 wherein a CO emission level of less than about 12 ppm is achieved.

13. The burner system of claim 1, wherein the manifold permits independent control of the first and the second sets of injectors resulting in improved flame density and shape.

14. The burner system of claim 1, where the refractory channels are arranged across a face of the refractory to substantially evenly distribute a mixture of combustion air and recirculated combustion product.

15. The burner system of claim 1, wherein the fuel is in a gaseous form and is mixed with air prior to delivery through the channels in the refractory.

16. The burner system of claim 1, wherein the refractory comprises an internal refractory manifold, the manifold constructed to distribute at least one of: combustion air, recirculated combustion product, and a gaseous fuel mixture to the combustion chamber via the channels in the refractory.

17. The burner system of claim 1, the system further comprising an oxygen ($O_2$) trim system for fine adjustment of $O_2$.

18. A low pollution emission burner system, the burner system comprising:

a fuel manifold comprising a housing, the housing defining an interior area comprising a first chamber and a second chamber;

a first set of injectors for injecting a fuel from the first chamber, the injectors disposed radially inward from the fuel manifold;

a second set of injectors for injecting the fuel from the second chamber into a stream of air to pre-mix the fuel and the air, the second set of injectors disposed radially inward from the fuel manifold;

a third set of injectors for injecting the fuel, the third set of injectors located in an area defined by at least one of the first and the second set of injectors; and a refractory located downstream of the fuel manifold, the refractory comprising a plurality of channels for introducing air and combustion product into a combustion chamber, the combustion chamber located downstream of the refractory.

19. The burner system of claim 18 further comprising a water injector located upstream of the first set of injectors, the water injector for injecting water within the burner.

20. A boiler system comprising the burner system according to claim 19.

21. The boiler system of claim 20 further comprising:

an exhaust stack connected to the combustion chamber for expelling combustion product from the boiler; and a recirculation tube attached to the exhaust stack for recirculating at least a portion of the combustion product.

22. A boiler system comprising the burner system according to claim 18.

23. The boiler system of claim 22 further comprising:

an exhaust stack connected to the combustion chamber for expelling combustion product from the boiler; and a recirculation tube attached to the exhaust stack for recirculating at least a portion of the combustion product.

24. A method for reducing pollution emissions from a burner, the method comprising the steps of:

providing a fuel manifold comprising a housing, the housing defining an interior area comprising a first chamber and a second chamber;

providing a first set of injectors, a second set of injectors, and a third set of injectors within a burner system, the first set of injectors connected to, and disposed radially inward from, the first chamber, the second set of injectors connected to the second chamber and the third set of injectors located in an area defined by at least one of the first and the second set of injectors;

introducing air and fuel into the burner;

injecting the fuel from the first set of fuel injectors;

injecting the fuel from the second set of fuel injectors into a stream of air to obtain pre-mixture of fuel and air;

injecting the fuel from the third set of fuel injectors;

igniting at least one of the fuel and the mixture of fuel and air from at least one set of fuel injectors to create a flame and a resulting combustion product;

recirculating at least a portion of combustion product into the burner; and passing at least one of air and at least a portion of the combustion product through at least one channel in the refractory to a location downstream of the refractory.

25. The method according to claim 24 wherein the passing step comprises passing both air and a portion of the combustion product via the at least one channel in the refractory to a location downstream of the refractory.

26. The method according to claim 24 further comprising the steps of creating a pressure differential downstream of at least one of the first, second, and third fuel sets of injectors by preventing steam from entering an area around at least of the first, second, and third sets of fuel injectors.

27. The method according to claim 24 further comprising providing independent control of the first set of fuel injectors and the second set of fuel injectors via a dual fuel manifold.

28. A low pollution emission burner system, the burner system comprising:

a fuel manifold comprising a housing, the housing defining an interior area comprising a first chamber and a second chamber;

a first set of injectors for injecting a fuel from the first chamber, the injectors disposed radially inward from the fuel manifold;

a second set of injectors for injecting the fuel from the second chamber into a stream of air to pre-mix the fuel and the air, the second set of injectors disposed radially inward from the fuel manifold;

a third set of injectors for injecting the fuel, the third set of injectors located in an area defined by at least one of the first and the second set of injectors;

a refractory located downstream of the fuel manifold, the refractory comprising a plurality of channels for introducing air and combustion product into a combustion chamber, the combustion chamber located downstream of the refractory; and a steam injector located upstream of the first set of fuel injectors, the steam injector for injecting steam within the burner;

wherein a $NO_x$ emission pollution level is about 8 ppm to less than 12 ppm.

29. The burner system of claim 28 wherein the $NO_x$ emission pollution level is preferably about 8 ppm up to about 11 ppm 30. The burner system of claim 29 wherein a CO emission level is less than about 50 ppm.

31. A low pollution emission burner system, the burner system comprising:

a fuel manifold comprising a housing, the housing defining an interior area comprising a first chamber and a second chamber;

a first set of injectors for injecting a fuel from the first chamber, the injectors disposed radially inward from the fuel manifold;

a second set of injectors for injecting the fuel from the second chamber into a stream of air to pre-mix the fuel and the air, the second set of injectors disposed radially inward from the fuel manifold;

a third set of injectors for injecting the fuel, the third set of injectors located in an area defined by at least one of the first and the second set of injectors;

a refractory located downstream of the fuel manifold, the refractory comprising a plurality of channels for introducing air and combustion product into a combustion chamber, the combustion chamber located downstream of the refractory; and a steam injector located upstream of the first set of fuel injectors, the steam injector for injecting steam within the burner.

wherein a $NO_x$ emission pollution level is about 8 ppm to about 11 ppm.

32. The burner system of claim 31 wherein CO emission level is less than about 50 ppm.

* * * * *